US005244505A

United States Patent [19]

Allison et al.

[11] Patent Number: 5,244,505

[45] Date of Patent: Sep. 14, 1993

[54] METHOD FOR CLEANING PIPE

[75] Inventors: Arlie Allison, Houston; Simon Tarsha, Fort Worth; James S. McMillan, Benbrook, all of Tex.

[73] Assignee: Pipe Rehab International, Inc., Dallas, Tex.

[21] Appl. No.: 839,993

[22] Filed: Feb. 24, 1992

Related U.S. Application Data

[62] Division of Ser. No. 553,732, Jul. 13, 1990, Pat. No. 5,090,079.

[51] Int. Cl.[5] ..... B08B 9/04; B08B 9/02

[52] U.S. Cl. ..... 134/22.11; 134/8; 134/22.12; 134/24; 15/104.05; 15/104.09; 15/104.31; 15/104.12

[58] Field of Search ..... 134/8, 22.11, 22.12, 134/24; 15/104.05, 104.09, 104.31, 104.12; 51/170 PT; 409/143

[56] References Cited

U.S. PATENT DOCUMENTS

| | | | |
|---|---|---|---|
| 710,798 | 10/1902 | Nowotny . | |
| 812,361 | 2/1906 | Pickles et al. . | |
| 812,361 | 2/1906 | Sewell | 15/104.61 |
| 1,208,203 | 12/1916 | Plimley | 15/104.12 |
| 1,272,253 | 7/1918 | Green . | |
| 1,628,070 | 5/1927 | Sladden | 15/104.12 |
| 2,062,850 | 12/1936 | Weaver et al. | 15/104.12 |
| 3,056,155 | 10/1962 | Harmes | 15/104.06 |
| 3,087,181 | 4/1963 | Chlebowski | 15/104.09 |
| 3,562,836 | 2/1971 | Frew et al. | 15/104.3 |
| 3,740,785 | 6/1973 | Latall | 15/104.12 |
| 4,206,313 | 6/1980 | Cavoretto | 134/24 |
| 4,724,007 | 2/1988 | Barry et al. | 134/8 |
| 4,773,115 | 9/1988 | Smith | 15/104.31 |
| 4,827,553 | 5/1989 | Turpin, Sr. et al. | 134/8 |

FOREIGN PATENT DOCUMENTS 1460031 12/1976 United Kingdom .

*Primary Examiner*—Theodore Morris
*Assistant Examiner*—Zeinab El-Arini
*Attorney, Agent, or Firm*—Blum Kaplan

[57] ABSTRACT

An apparatus is shown for cleaning a pipe. The apparatus includes a rigid stem and a motor stationarily mounted on the stem. An outer body surrounds the motor and is rotatably mounted on the rigid stem. A fluid conduit is connected to the stem and to a source of fluid under pressure for supplying fluid to the motor for driving the motor. The fluid conduit also connected to a pulling unit for pulling the apparatus through the pipe to be cleaned. Fluid supplied through the fluid conduit to the stem and through the stem to the fluid powered motor provides rotational propulsion to turn the outer body as the apparatus is moved through the pipe to be cleaned.

15 Claims, 4 Drawing Sheets

METHOD FOR CLEANING PIPE

This is a division of application Ser. No. 07/553,732 filed Jul. 13, 1990 now is U.S. Pat. No. 5,090,079.

BACKGROUND OF THE INVENTION

1. Field of the Invention

The present invention relates generally to a method and apparatus for cleaning pipe, particularly for cleaning a pipe in place in the ground by reaming, scraping and descaling the pipe to remove debris, obstructions and encrustations in the pipe interior.

2. Description of the Prior Art

Various devices are shown in the prior art for cleaning, scraping and reaming water, steam, gas and other tubes, pipes, conduits and mains. For instance, a need exists for cleaning encrusted pipes in which deposits have been made on the inner walls of the pipe by precipitation of the fluid passing through it, such as occurs, for instance, with water containing lime or iron. A need also exists for an apparatus to remove obstructions and foreign matter in the interior of pipes, as when it is desired to install a synthetic liner within the existing pipe. By providing a uniform interior surface, improved bonding can be achieved between the synthetic liner and the existing pipe interior. For instance, it is desirable in some applications to line the interior of an existing pipeline to reduce corrosion and frictional drag to flow of fluid through the pipe. In the case of an existing sewer main, it is often desirable to remove obstructions and clean the sewer line interior in order that a synthetic liner can be installed to restore the integrity of the main for the passage of fluids. It is also desirable to remove offsets in pipe joints which may exist in the sewer line interior.

Particularly with respect to in-ground pipe cleaning operations, such as sewer mains, the operations were hindered by the length of the drive mechanism utilized or which was required to be fed out to the cleaning apparatus. Also, hydraulic drives have a practical running limit due to pressure loss in the return fluid.

It is an object of the present invention to provide a cleaning apparatus which can be fed out for greater distances than heretofore possible in pipe cleaning operations, such as in-ground sewer reaming operations.

Various other applications for the pipe cleaning apparatus and method of the invention will be apparent to those skilled in the art based upon the following written description.

SUMMARY OF THE INVENTION

The apparatus for cleaning a pipe of the invention includes a rigid, longitudinally extending stem. A motor is stationarily mounted on the stem. An outer body surrounds the motor and is rotatably mounted on the longitudinally extending stem. Drive means are provided for connecting the motor to the outer body. A power coupling is connected to the stem for supplying power to the motor, the coupling also being connected to a pulling unit for pulling the apparatus through the pipe to be cleaned. Power supplied through the stem to the motor provides rotational propulsion to turn the outer body as the apparatus is moved through the pipe to be cleaned.

Preferably, the motor is a water powered motor and the power coupling is a water conduit connected to the longitudinally extending stem. The outer body preferably includes hardened regions on the exterior thereof which are selectively sized to ream the interior of the pipe to be cleaned.

In the method of the invention, a fluid powered motor is stationarily mounted on a rigid stem, the rigid stem being provided with a hollow interior. An outer body is rotatably mounted on the longitudinally extending stem with the outer body surrounding the fluid powered motor. The fluid powdered motor is connected to the outer body by a suitable drive means. One end of a fluid conduit is connected to the stem, the fluid conduit being connected with a source of fluid under pressure for powering the fluid motor. The opposite end of the fluid conduit is connected to a pulling unit for pulling the apparatus through the pipe to be cleaned. Fluid is supplied under pressure through the stem to the motor to provide rotational propulsion to turn the outer body while simultaneously pulling the apparatus through the pipe with the pulling unit connected to the fluid conduit, thereby causing the apparatus to ream the pipe interior.

Preferably, the fluid motor is a water powered motor and the fluid conduit is connected with a source of water pressure for providing rotational propulsion for the apparatus.

Additional objects, features and advantages will be apparent in the written description which follows.

DETAILED DESCRIPTION OF THE INVENTION

Figure 1:
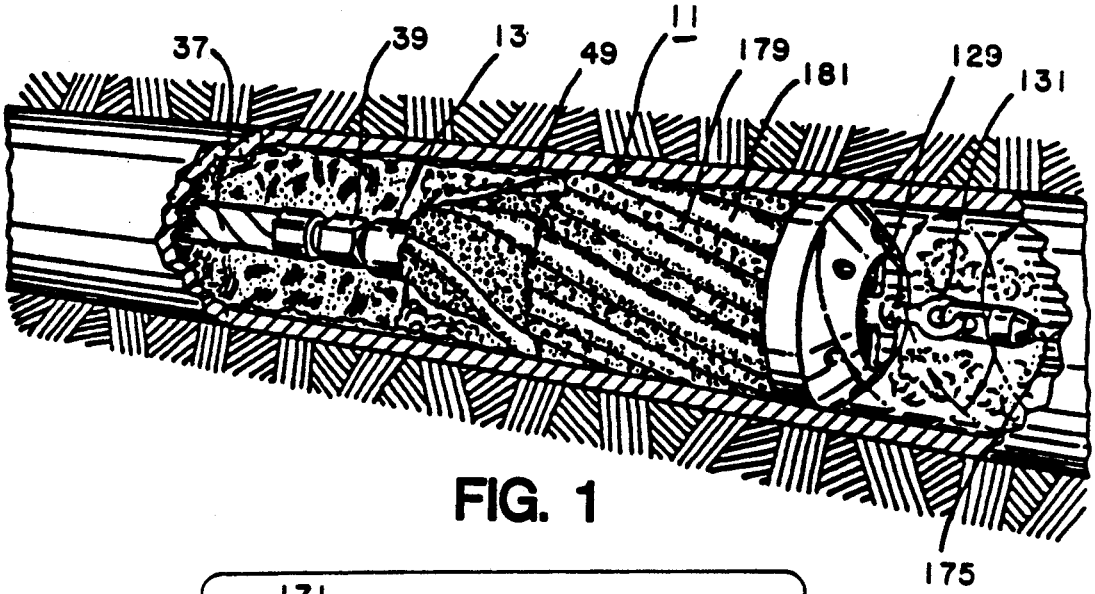
FIG. 1 is a side, perspective view of the pipe cleaning apparatus of the invention, showing the apparatus in place in an underground pipe, with portions of the pipe broken away for ease of illustration.
Figure 4:
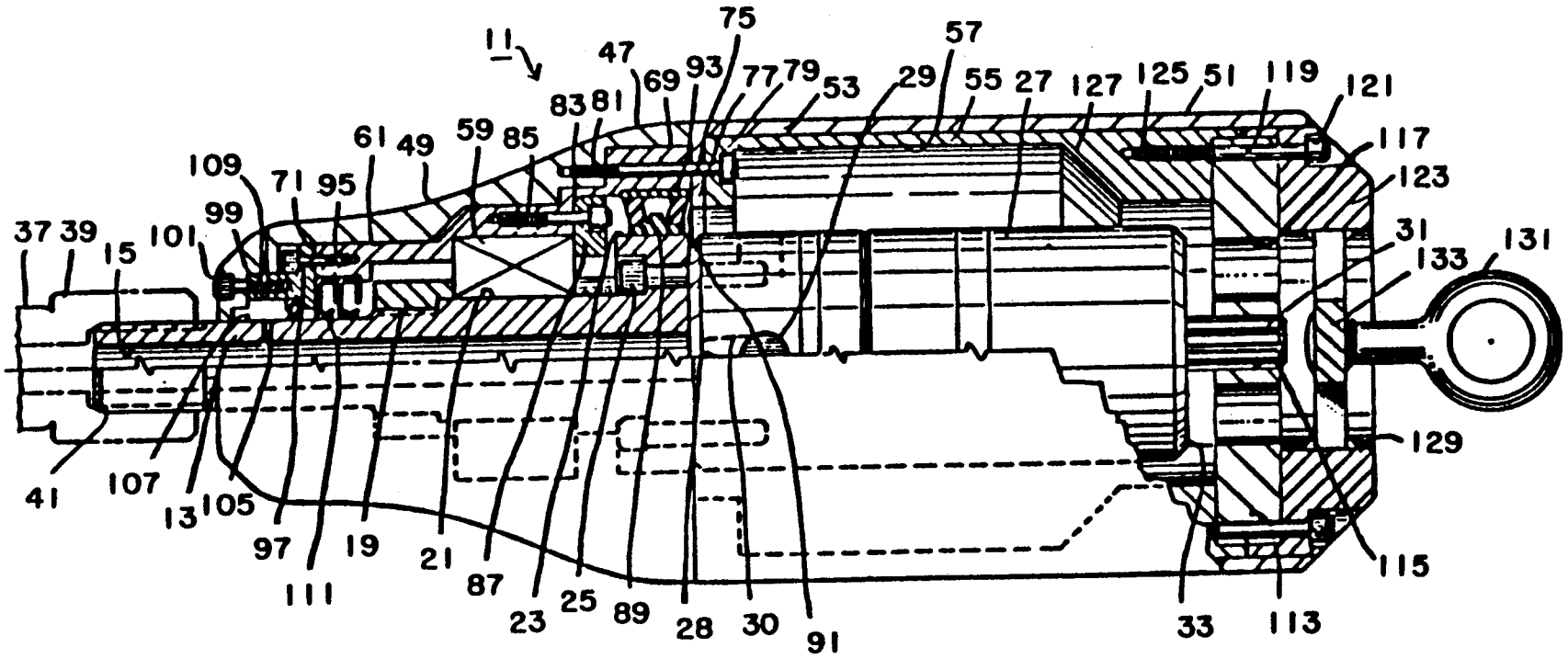
FIG. 4 is a side, cross-sectional view of the pipe cleaning apparatus of the invention.

FIG. 1 shows the pipe cleaning apparatus of the invention designated generally as 11. As best seen in FIG. 4, the pipe cleaning apparatus 11 includes a rigid, longitudinally extending stem 13. The stem 13 has a hollow, cylindrical interior 15 and a series of stepped exterior regions 19, 21, 23. Stepped exterior region 23 forms an external flange provided with bolt receiving recesses for receiving a plurality of threaded bolts 25. The threaded bolts 25 are used to stationarily mount a motor 27 on the stem 13. Preferably, the motor 27 is a fluid powered motor. A variety of fluid powered motors are known in the art which can be utilized with the apparatus of the invention. For instance a fluid powered motor can be obtained commercially from Char-Lynn Corporation, of Eden Prairie, Minnesota as the Series A, H and S "Gerotor" motors. Most preferably, the motor is a water powered motor.

The motor 27 has an inlet opening 28 which communicates with the hollow interior 15 of the stem 13 for receiving pressurized fluid. The motor also has an internal chamber 30 which is arranged to communicate with the inlet opening and the hollow interior of the stem 13. The motor has an internal gerotor which is turned by the passage of water through the internal chamber, thereby powering a driven shaft 31 which extends from the rear face 33 of the motor 27 along the longitudinal axis 35 of the apparatus.

A fluid conduit such as coil tubing 37 (FIGS. 1 and 4) is connected to the stem 13 by means of a threaded coupling 39 which matingly engages the threaded exterior 41 of the stem outer extent. Although coil tubing of the type used in well workover operations is used in the preferred embodiment, any of a number of high pressure, bi-directional steel reinforced hydraulic hoses could be utilized. The fluid conduit is connected to a source of fluid under pressure for supplying fluid under pressure to the internal chamber 30 of the motor 27 to power the motor. As will be presently explained, the fluid conduit 37 is also connected to a pulling unit such as the winch 43 located on the rear of a service truck 45 at a surface location. In this way, the fluid conduit 37 not only supplies pressurized fluid to the fluid motor 27, but also serves as a means for pulling the apparatus through the pipe to be cleaned. In this manner, one end of fluid conduit 37 connects to stem 13, while the other end connects to a pulling unit such as winch 43. Winch 43 by means of fluid conduit 37 pulls the apparatus through the pipe to be cleaned.

Returning to FIG. 4, an outer body 47 completely surrounds the fluid powered motor 27. The outer body 47 includes a leading, tapered nose cone portion 49 and a trailing body portion 51 which serves as a motor housing for the motor 27. The external diameter of the outer body 47 increases between the tapered nose cone portion 49 and the body portion 51, giving the overall appearance of a bottle-shape. The external diameter of the outer body 47 is sized to be closely received within the interior of the pipe to be cleaned. The body portion 51 includes a generally cylindrical outer shell 53 and an inner shell 55 which is received concentrically within the outer shell 53. The inner shell 55 is spaced-apart from the exterior of the motor 27 forming an internal cavity 57. The internal cavity 57 allows water passing from one or more exhaust ports 29 leading from the motor internal chamber to enter the internal cavity 57 and flow about the exterior of the motor 27, thereby serving to cool the motor.

Figure 6:
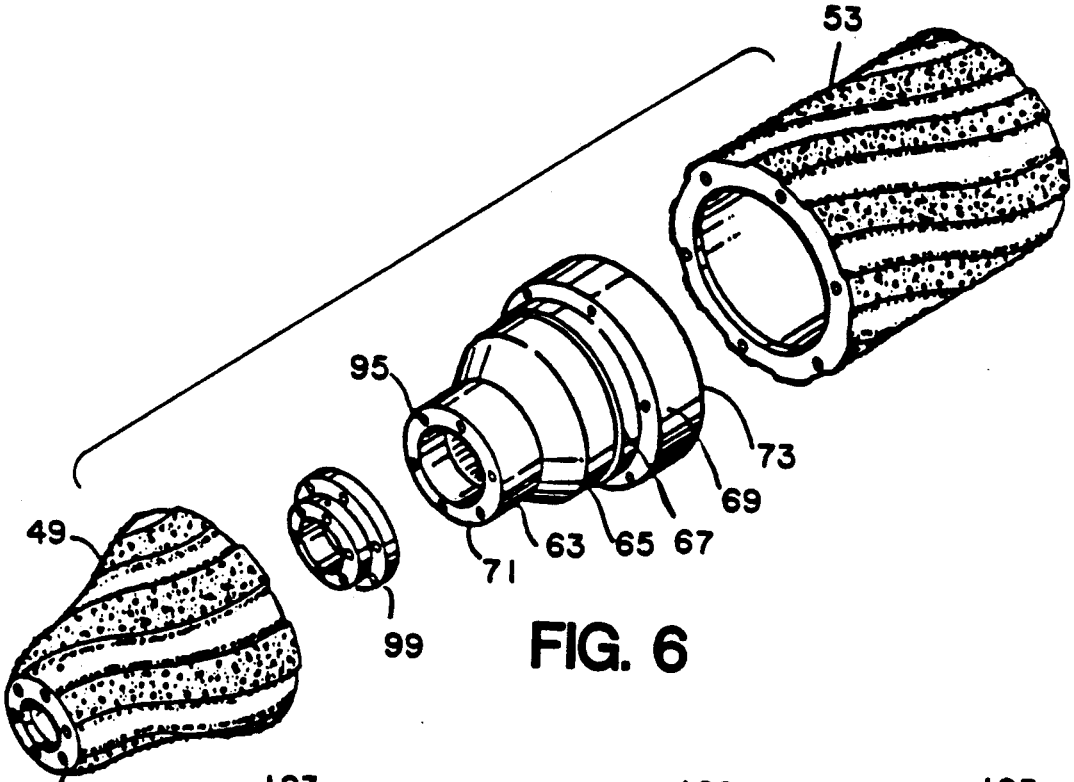
FIG. 6 is an exploded view of certain of the internal components of the apparatus of the invention.

The outer body 47 is rotatably mounted on the longitudinally extending stem by means of a bearing assembly such as the double row Timken bearing 59. The bearing assembly 59 is positioned within the interior of the apparatus by means of a spacer member 61 which locates the bearing assembly 59, as well as the other internal components of the apparatus. The spacer member 61, has stepped exterior regions 63, 65, 67, 69 (FIG. 6) which gradually increase in external diameter from the leading end 71 to the trailing end 73 thereof. The trailing end 73 is provided with a plurality of bolt receiving recesses for receiving connecting bolts 75 (FIG. 4). The connecting bolts 75 pass through mating bores provided in the flange portions 77, 79 of the outer shell 53 and inner shell 55. The nose cone portion 49 has mating threaded bores 81 for engaging the connecting bolts 75, whereby the outer shell 53 and inner shell 55 are assembled to the tapered nose cone portion 49.

An internal shoulder 83 formed in the spacer member 61 is provided with a plurality of circumferentially spaced threaded bores for receiving assembly bolts 85. Assembly bolts 85 are used to mount a retaining ring 87 which is used to mount the bearing assembly 59 within the interior of the apparatus.

A fluid seal 89 is located within an annular passage 91 which is located beneath the stepped region 69 of the spacer 61. The fluid seal 89 is a ring-shaped member formed of a suitable elastomer and forms a fluid tight seal between the internal cavity 57 of the apparatus and the bearing assembly 59. A circumscribing inlay 93 can be located beneath the stepped region 69 within the interior of the spacer 61 to form a contact surface for the fluid seal 89 as the outer body 47 is rotated about the stationary stem 13 and motor 27.

The leading end 71 of the spacer member 61 is provided with a plurality of circumferentially spaced threaded bores 95. Bolts 97 are received within the mating bores and are used to mount an end ring 99. A plurality of end bolts 101 pass through bores 103 (FIG. 6) provided within the tapered nose cone portion 49 and are used to assemble the nose cone portion 49 to the end ring 99. As shown in FIG. 4, the stem outer extent has one or more orifices 105 which allow fluid entering the hollow interior 15 to pass radially outward into a cavity 107 within the interior of the nose cone portion. One or more orifices 109 allow a small amount of fluid to pass from the cavity 107 radially outward from the exterior of the nose cone portion 49. An annular seal ring 111 located between the exterior of the stem 13 and the interior of the internal spacer 61 isolates the cavity 107 from the bearing assembly 59.

As shown in FIG. 4, drive means are provided for connecting the output shaft 31 of the motor 27 to the outer body 47 for rotating the outer body about the stationary stem 13 and motor 27. Preferably, the drive means includes a driven plate 113 which is engaged on the driven shaft 31 in a plane generally perpendicular thereto by means of a splined opening 115 which matingly engages the external splines provided on the driven shaft 31. The driven plate 113 has a plurality of outlet openings 117 which are circumferentially spaced about the driven shaft 31 for exhausting fluid from the internal cavity 57 to the exterior of the apparatus as the apparatus is being pulled by the fluid conduit 37. A plurality of bores 119 spaced about the outer periphery of the driven plate 113 are adapted to receive connecting bolts 121 which are used to assemble a butt plate 123 on the trailing end of the apparatus. The connecting bolts 121 have threaded ends 125 which are received within mating openings provided in the end portion 127 of the inner shell 55.

The butt plate 123 includes a circular opening 129 for exhausting water passing through the outlet openings 117. The circular opening 129 also has affixed therein, as by welding, a tow ring 131 having a T-shaped attachment portion 133.

Figure 2A:
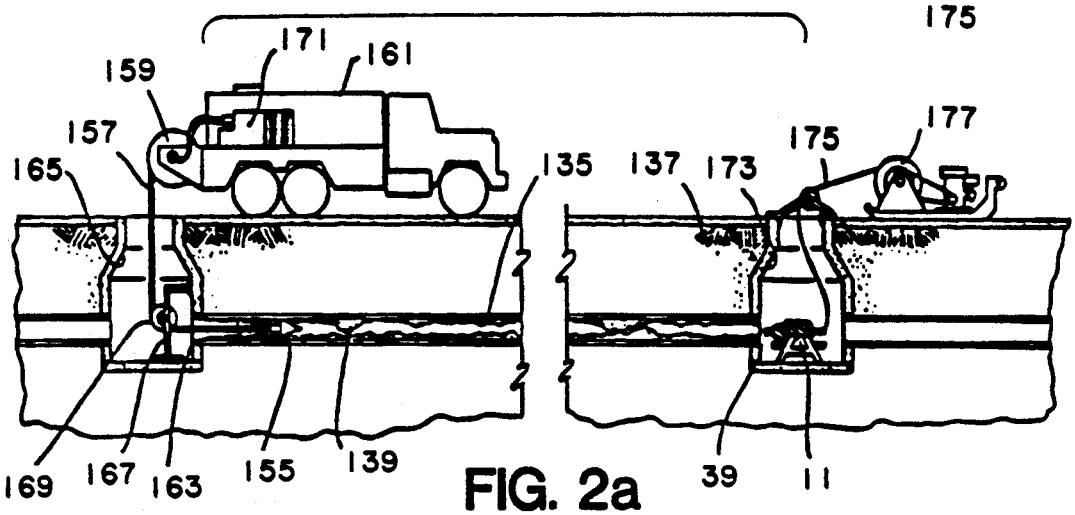
FIG. 2A is a simplified, schematic view, of the operation of the method of the invention showing the water nozzle blaster which is used to remove large debris from the pipe to be cleaned.

The method of the invention will be described with reference to FIGS. 2A–2B. In the operation shown in FIG. 2A, the apparatus 11 is being used to clean a sewer line 135 which extends horizontally in the ground 137 and which has large debris 139 within the interior thereof. Although the invention will be described with reference to the re-work of a sewer main, it will be apparent to those skilled in the art that the apparatus of the invention can be utilized in a variety of pipe cleaning operations. As shown in greater detail in FIGS. 3A and 3B, the sewer main has one or more pipe joints 141, 143 which in this case have become misaligned at the coupling 145. The joint 143 also has cracks 147 into which plant roots and other debris have accumulated. The joint 141 has an incoming line 149 which includes an inner extent 151 which protrudes within the internal diameter 153 of the joint.

Returning to FIG. 2A, a gross cleaning implement such as the nozzle blaster 155 is first connected to the fluid conduit 157 which is dispensed from a take-up reel 159 located on the rear of the service truck 161. The nozzle blaster 155 will be familiar to those skilled in the art and is used to open a pathway in the pipe interior. Other gross cleaning implements could be used as well, since the pipe internal sidewalls are not being reamed in this step. For instance, U.S. Pat. No. 1,628,070, issued to Sladden, May 10, 1927, shows a self propelled hose nozzle, the disclosure of which is incorporated herein by reference. The nozzle blaster 155 is run into the entrance 163 of the pipe joint which is exposed within the manhole 165 at a first horizontal location. A stand 167 and idler 169 dispense the fluid conduit 157. Water under pressure is pumped from the pump unit 171 on the service truck 161 to drive the nozzle blaster 155 in the direction of a second manhole 173 located at a second horizontal position of the pipe joint to be cleaned. The water nozzle blaster 155 clears a pathway within the pipe joint by removing gross debris within the joint. It is loosely spaced within the internal diameter of the joint and exhausts water to the rear as it is driven forward.

Once the nozzle blaster has reached the second manhole location 173, it is removed and is replaced with the apparatus of the invention 11. The threaded coupling 39 of the apparatus 11 (FIG. 1) is used to attach the apparatus to the fluid conduit 157 which now extends through the pipe joint. As shown in FIG. 2A, the apparatus 11 also has attached thereto a wire cable 175 which is played out from a power winch 177 located at the surface.

Figure 2B:
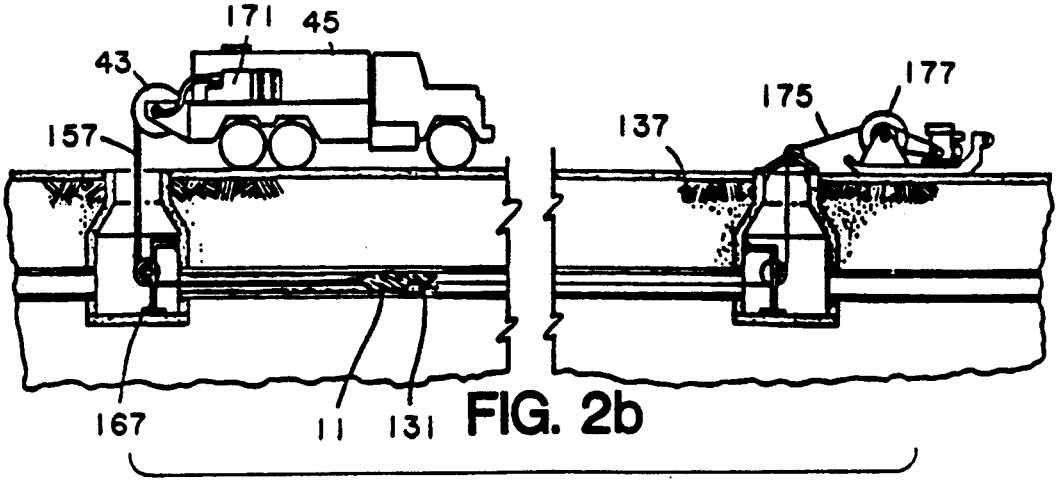
FIG. 2B is a simplified, schematic view, similar to 2A, showing the pipe cleaning apparatus of the invention which has been attached to the fluid conduit, the cleaning apparatus being pulled through the pipe to be cleaned by the pulling unit or the surface.
Figure 3A:
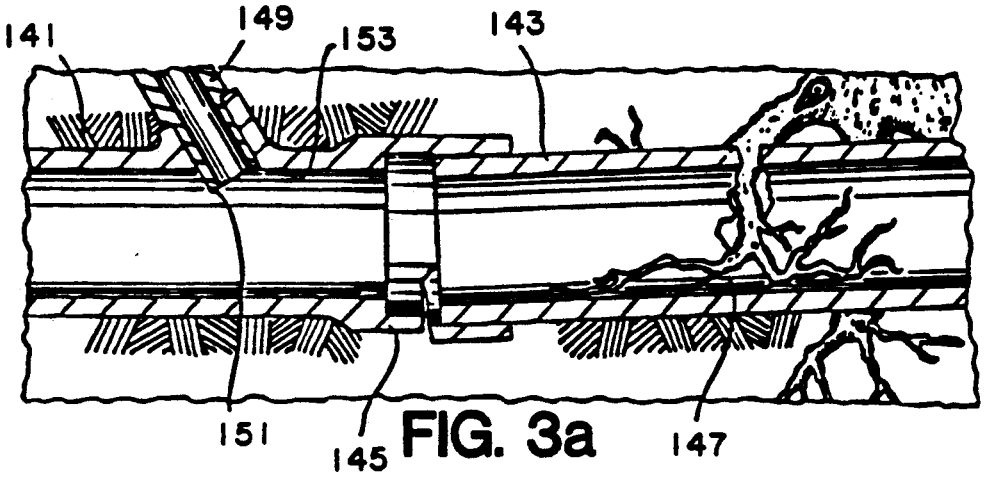
FIG. 3A is a partial, sectional view of a pipe to be cleaned with the apparatus of the invention showing the obstructions within the pipe interior.

As shown in FIG. 2B the pipe is then reamed by actuating the pulling unit 43 on the service truck 45 as water is being pumped under pressure from the pump unit 171 through the fluid conduit 157. Water pumped through the fluid conduit and through the stem 13 powers the water motor 17. The driven shaft 31 of the water motor acts through the driven plate 113 to rotate the outer body 47 about the stationary stem 13 and motor 27. As the apparatus is being pulled to the left when viewed in FIG. 1, water is being exhausted through the circular opening 129 provided in the butt plate 123 of the apparatus.

Figure 7:
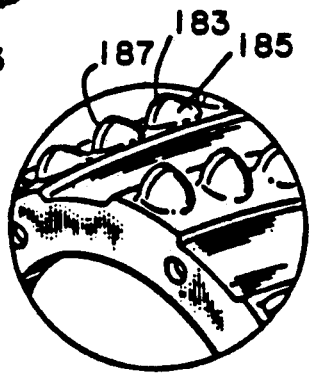
FIGS. 7–9 are isolated views of alternate exterior surfaces which can be provided on the apparatus of the invention.
Figure 8:
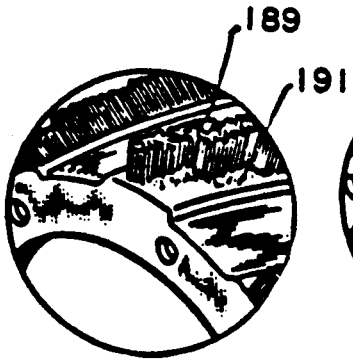
Figure 9:
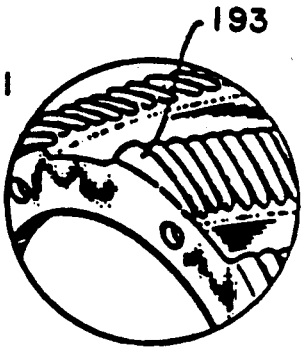

The outer body 47 is preferably provided with hardened regions such as the spiralling regions of tungsten carbide hardfacing 179 (FIG. 1). In the embodiment shown, the hardened regions 179 alternate with spiralling grooves 181 which begin at the tapered nose cone region 49 and terminate at the trailing end of the apparatus. The exterior of the outer body 47 can also be provided with other pipe cleaning profiles, such as those shown in FIGS. 7–9. FIG. 7 shows a plurality of circular polycrystalline diamond cutting elements 183 positioned on backings 185. The cutting faces 187 of the cutting elements are arranged in radial planes which contact the pipe interior as the outer body is being rotated. FIG. 8 shows another embodiment of the outer body exterior in which longitudinally arranged brush elements 189 are positioned on the spiralling lands 191 provided on the outer body exterior. FIG. 9 shows another arrangement of raised tungsten carbide elements 193 used to contact the pipe interior.

As shown in FIG. 2B, the wire cable 175 which is attached to the tow ring 131 of the apparatus 11 allows the apparatus to be retrieved by means of the power winch 177 should the apparatus become stuck within the pipe being cleaned. Otherwise, the apparatus is pulled through the pipe by means of the pulling unit 43 on the service truck 45. Once the reaming apparatus has been pulled to the first horizontal location at the manhole 165, it is removed from the water conduit. The water nozzle blaster can then be reinstalled on the water conduit, the service truck moved to another location, and the process repeated.

Figure 5:
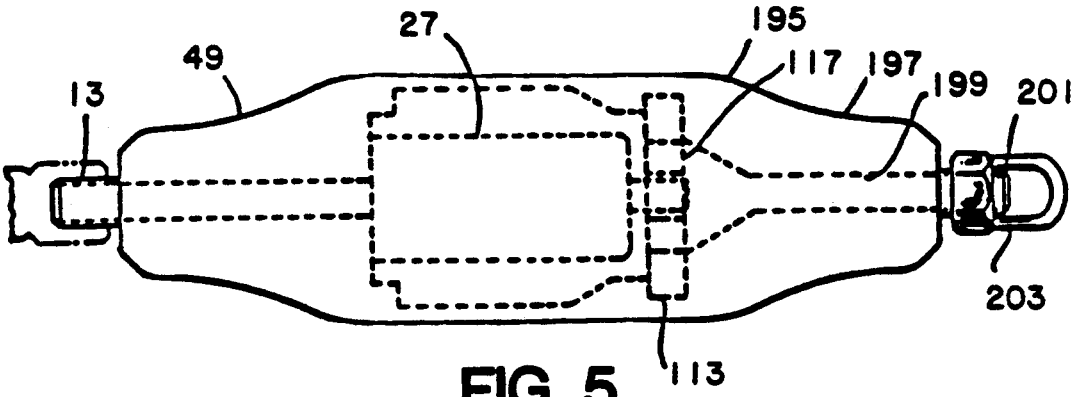
FIG. 5 is a simplified, overall view of another version of the pipe cleaning apparatus of the invention, the apparatus being provided with a doubly tapered external housing for pulling in either of two opposite directions within a pipe.

FIG. 5 shows another embodiment of the apparatus 11 in which the apparatus is provided with a doubly tapered outer body 195. The apparatus is identical to that previously described with reference to FIG. 4 except that the butt plate 123 is replaced with a second tapered section 197 which slopes in the opposite direction from the leading tapered nose cone portion 49. A funnel shaped passage 199 is provided within the second tapered section 197 for exhausting the water passing from the outlet openings 117 of the driven plate 113 to the trailing end of the apparatus. The funnel shaped passage terminates in an exhaust pipe 201 which is also the connecting point for a tow ring 203. In this embodiment of the invention, the water supplied through the stem 13 to the motor 27 rotates the entire doubly tapered outer body 195 about the stationary motor 27. In this way, the housing 195 would turn and ream the pipe interior whether being pulled by the fluid conduit in one direction or by the tow ring 203 in the opposite direction.

Figure 3B:
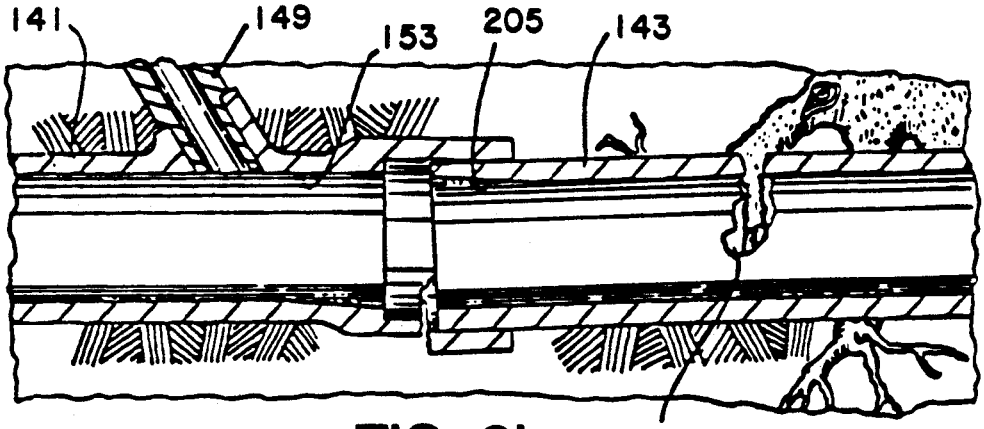
FIG. 3B is a subsequent view of the pipe interior of FIG. 3A after having been reamed with the apparatus of the invention.

FIG. 3B shows the pipe joints 141, 143 after being reamed with the apparatus 11 of the invention. It will be noted that the apparatus has sheared the inner extent 151 of the incoming line 149 to present a smooth internal diameter for the pipe joint. The device has also smoothed the protruding portions 205 of the pipe joint and has removed the debris which was extending within the crack 147.

Figure 3C:
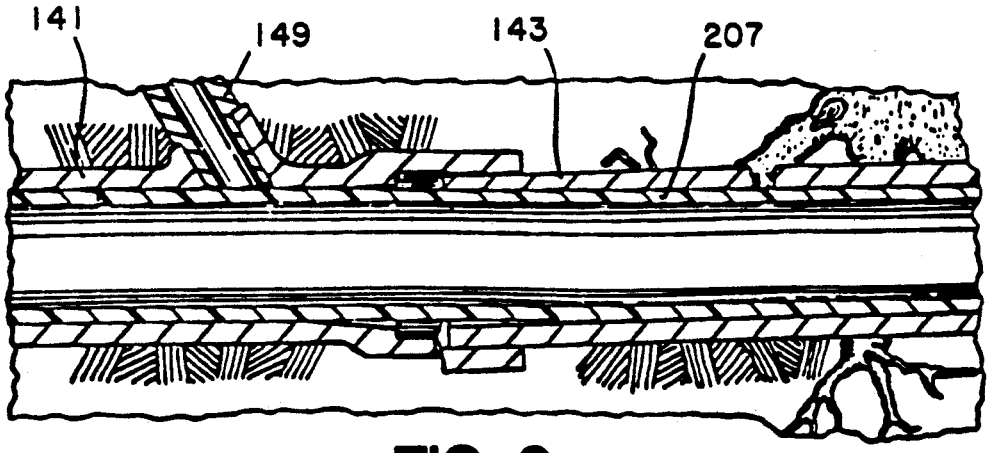
FIG. 3C shows the underground pipe of FIG. 3B having been lined with a synthetic liner.

FIG. 3C shows the pipe joints 141, 143 after a subsequent operation in which a synthetic liner 207 has been installed within the sewer main. The smooth internal diameter 153 facilitates the uniform seating of the linear 207 within the pipe joints.

An invention has been provided with several advantages. The apparatus of the invention is relatively simple in design and economical to manufacture utilizing commerically available parts. The apparatus can perform a variety of pipe cleaning and reaming operations. Because the apparatus can be water powered instead of being operated by conventional hydraulic oil, it can be operated at much greater distances from the pump truck than was previously possible. The water powered version of the device is non-polluting and environmentally safe making it ideally suited for use in sewer and water supply applications. It is not necessary to have a drive mechanism for the apparatus located downhole since the apparatus is fluid powered. Because the fluid conduit which is used to power the apparatus can pass around turns, it is not necessary to perform extensive excavation of underground sewage and water lines, as was done in the past. The device can be provided with a variety of exterior surfaces for reaming, scrapping, descaling, brushing and other operations within the pipe being worked.

While the invention has been shown in its preferred form, it is not thus limited but is susceptible to various changes and modifications without departing from the spirit thereof.

We claim:

1. A method of cleaning a pipe having an obstructed interior, the method comprising the steps of:

inserting a reaming apparatus within the pipe interior, the reaming apparatus being provided with a rigid, longitudinally extending stem and a motor stationarily mounted on the stem, the motor being surrounded by an outer body which is rotatably mounted on the longitudinally extending stem, the motor also being provided with drive means which connect the motor to the outer body for rotating the outer body with respect to the stationary motor and stem;

connecting a power coupling to the stem for supplying power to the motor, the power coupling also being connected to a pulling unit for pulling the apparatus through the pipe to be cleaned;

supplying power through the power coupling to the stem and, in turn, to the motor, to thereby provide rotational propulsion to turn the outer body as the apparatus is moved through the pipe to be cleaned;

actuating the pulling unit to pull the reaming apparatus as the motor is supplying rotational propulsion to the outer body.

2. A method of cleaning a pipe having an obstructed interior, the method comprising the steps of:

stationarily mounting a fluid powered motor on a rigid stem, the rigid stem having a hollow interior;

rotatably mounting an outer body on the stem with the outer body surrounding the fluid powered motor;

connecting the fluid powered motor to the outer body with drive means;

connecting one end of a fluid conduit to the stem, the fluid conduit being connected with a source of fluid under pressure for powering the fluid motor;

connecting the opposite end of the fluid conduit to a pulling unit for pulling the apparatus through the pipe to be cleaned;

supplying fluid under pressure through the stem to the motor to provide rotational propulsion to turn the outer body while simultaneously pulling the apparatus through the pipe with the pulling unit connected to the fluid conduit, thereby causing the outer body to ream the pipe interior.

3. The method of claim 2, wherein the fluid motor is a water powered motor and wherein the fluid conduit is connected with a source of water under pressure for providing rotational propulsion for the outer body.

4. The method of claim 3, wherein the outer body is provided with hardened regions of tungsten carbide on the exterior thereof, the hardened regions being selectively sized to ream the interior of the pipe to be cleaned.

5. A method of cleaning a pipe having interior sidewalls and which extends horizontally in the ground, the pipe have large debris within the interior thereof, as well as obstructions on the pipe interior sidewalls, the method comprising the steps of:

inserting a nozzle blaster into the pipe interior at a first location along the horizontal length thereof, the nozzle blaster having a front face and having a rear face connected to a trailing water conduit which supplies water under pressure to the nozzle blaster to propel the nozzle blaster forward and remove large debris within the pipe interior;

running the nozzle blaster along the horizontal length thereof to a second location;

removing the nozzle blaster from the water conduit at the second location and connecting one end of the water conduit to a reaming apparatus, the reaming apparatus being provided with a rigid, longitudinally extending stem and a water powered motor stationarily mounted on the stem, the motor being connected by drive means to an outer body which is rotatably mounted on the longitudinally extending stem;

connecting an opposite end of the water conduit to a pulling unit on the surface of the ground for pulling the reaming apparatus through the pipe to be cleaned;

supplying water under pressure through the water conduit to the motor to provide rotational propulsion to turn the outer body while simultaneously pulling the apparatus through the pipe with the pulling unit connected to the fluid conduit, thereby causing the outer body to ream the pipe interior.

6. The method of claim 5, further comprising the steps of:

continuing to pull the reaming apparatus with the pulling unit until the apparatus has been returned to the first horizontal location in the pipe.

7. The method of claim 6, further comprising the steps of:

removing the reaming apparatus from the water conduit;

reinstalling the nozzle blaster on the water conduit;

running the nozzle blaster to a third horizontal location in the pipe interior.

8. The method of claim 6, wherein the reaming apparatus has first and second ends, the water conduit being connectable to the first end, wherein a cable is attached to the second end of the reaming apparatus, and further comprising the step of pulling the cable to retrieve the reaming apparatus in case it becomes stuck within the pipe being cleaned.

9. The method of claim 6, wherein the reamer apparatus includes a doubly tapered outer body, whereby the reamer apparatus reams the pipe when pulled in either of two opposite longitudinal directions within the pipe.

10. A method for cleaning a pipe, comprising the steps of:

(a) introducing a fluid conduit into a pipe at a first location and moving the fluid conduit through the pipe to a second location;

(b) at the second location, connecting the fluid conduit to a pipe cleaning apparatus which includes a fluid motor and an outer body which is rotated by the fluid motor;

(c) pulling the fluid conduit to tow the pipe cleaning apparatus through the pipe to the first location; and (d) supplying fluid under pressure to the motor via the fluid conduit while step (c) is being conducted.

11. The method of claim 10, wherein step (a) comprises the steps of:

connecting the fluid conduit to a nozzle blaster;

inserting the nozzle blaster into the pipe at the first location;

supplying fluid under pressure to the nozzle blaster through the fluid conduit to drive the nozzle blaster to the second location; and removing the nozzle blaster from the fluid conduit at the second location before step (b) is conducted.

12. The method of claim 11, further comprising the steps of removing the fluid conduit from the pipe cleaning apparatus at the first location;

re-connecting the fluid conduit to the nozzle blaster;

supplying fluid under pressure to the nozzle blaster through the fluid conduit to drive the nozzle blaster through the pipe to a third location, the first location being disposed between the second and third locations;

at the third location, disconnecting the nozzle blaster from the fluid conduit and connecting it to the pipe cleaning apparatus; and pulling the fluid conduit to tow the pipe cleaning apparatus through the pipe to the first location while supplying fluid under pressure to the motor via the fluid conduit.

13. The method of claim 10, further comprising the steps of:

moving the fluid conduit through the pipe from the first location to a third location, the first location being disposed between the second and third locations;

at the third location, connecting the fluid conduit to the pipe cleaning apparatus;

pulling the fluid conduit to tow the pipe cleaning apparatus through the pipe to the first location while supplying fluid under pressure to the motor via the fluid conduit.

14. The method of claim 10, wherein the pipe cleaning apparatus additionally includes a longitudinally extending stem on which the motor is stationarily mounted, wherein the outer body is rotatably mounted on the stem and surrounds the motor, and wherein step (b) comprises connecting the fluid conduit to the stem.

15. The method claim 10, wherein the pipe cleaning apparatus has first and second ends, wherein step (b) is conducted by connecting the fluid conduit to the first end of the pipe cleaning apparatus, and further comprising the step of pulling the pipe cleaning apparatus toward the second location using a cable connected to the second end of the pipe cleaning apparatus if it becomes stuck while cleaning the pipe.

* * * * *